US005330363A

United States Patent [19]

Gardner et al.

[11] Patent Number: 5,330,363

[45] Date of Patent: Jul. 19, 1994

[54] IC PACK CONNECTOR APPARATUS WITH SWITCH MEANS

[75] Inventors: Michael J. Gardner, Pleasanton; Jerry D. Kachlic, Milpitas, both of Calif.; Paul M. O'Brien, Knockerra Kilrush, Ireland

[73] Assignee: Molex Incorporated, Lisle, Ill.

[21] Appl. No.: 61,133

[22] Filed: May 13, 1993

[51] Int. Cl.[5] ..... H01R 13/635

[52] U.S. Cl. ..... 439/188; 439/160; 200/51.09

[58] Field of Search ..... 439/188, 489, 490, 159, 439/160; 200/51.09

[56] References Cited

U.S. PATENT DOCUMENTS 4,887,188 12/1989 Yoshida et al. ..... 439/188
4,900,273 2/1990 Pernet ..... 439/188
5,013,255 5/1991 Juret et al. ..... 439/188
5,033,972 7/1991 Komatsu et al. ..... 439/377

*Primary Examiner*—Gary F. Paumen
*Attorney, Agent, or Firm*—Stacey E. Caldwell

[57] ABSTRACT

A connector apparatus provides an interconnection between an IC pack and a printed circuit board. The apparatus includes a header connector for mounting on the printed circuit board and into which the IC pack is inserted and from which it is ejected. A plurality of terminals on the header connector are adapted for interconnection of the IC pack to electrical traces on the printed circuit board. An electrical switch is provided on the header connector and is actuated in response to movement of the IC pack therewithin. The switch is interconnected to electrical traces on the printed circuit board.

5 Claims, 5 Drawing Sheets

10
12
14
14a
16
18
19
20
22
24
26
28
30
32
32a
32b
32c
34
36
38
40
42
44
A
B
C
D

IC PACK CONNECTOR APPARATUS WITH SWITCH MEANS

FIELD OF THE INVENTION

This invention generally relates to the art of electrical connectors and, particularly, to a connector apparatus for providing interconnection between an IC pack and a printed circuit board and, further, to such an apparatus which includes a switch means actuatable in response to movement of an IC pack therewithin.

BACKGROUND OF THE INVENTION

A conventional connector apparatus for an IC pack or memory card includes a generally U-shaped connector assembly having guide grooves inside a pair of side portions, with a connector section joining or extending between the side portions. A planar IC pack is inserted into the apparatus between the side portions. A transverse array of socket terminals at an edge of the IC pack electrically interconnect with an associated array of pin terminals on the connector section.

Such connector apparatus often are provided as header connectors used for interconnecting the semiconductor circuit of the IC pack to an external circuit such as a main electronic unit. The header connector may be used with an IC pack or memory card for removably coupling the IC pack to a printed circuit board. The IC pack is inserted into the header connector and is extracted therefrom as needed. The extraction force of the IC pack, i.e. the force between the respective terminal pins on the header connector and the respective socket terminals of the IC pack, is relatively high due to the tight fit required to obtain a good electrical interconnection between the terminals. These terminals typically are disposed at a high density which further increases the extraction forces. Often, when an IC pack is to be extracted from a header connector, the card is grasped by a user and simply pulled out. Consequently, a variety of ejecting mechanisms have been incorporated in various connector apparatus, such as the header connectors, for facilitating ejecting an IC pack from a header connector.

One of the problems with IC pack connector apparatus of the character described above, particularly in header connectors employed with printed circuit boards, is that the insertion or extraction of the IC packs with respect to the connectors can interfere with ongoing processes or interrupt data transfer, for example, between the ic pack and the main electronic unit. This invention is directed to solving such problems by providing a switch means in the connector apparatus, the switch means being actuated in response to the movement, i.e. the insertion or extraction of an IC pack with respect to the apparatus. Therefore, the switch means can be used to shut down various processing through the apparatus during insertion or extraction of the IC pack into or from the header connector. The switch means may be incorporated in the ejecting mechanism so that major modifications to standard IC packs and the interfacing of the packs with the connector apparatus do not have to be made.

SUMMARY OF THE INVENTION

An object, therefore, of the invention is to provide a new and improved connector apparatus for providing an interconnection between an IC pack or memory card and an electronic unit, such as a printed circuit board, and including a switch means in the apparatus.

In the exemplary embodiment of the invention, the connector apparatus is illustrated for interconnection between an IC pack and a printed circuit board. The apparatus includes a header connector for mounting on the printed circuit board and into which the IC pack is inserted and from which it is ejected. A plurality of terminals are mounted in the header connector and are adapted for interconnection of the IC pack to electrical traces on the printed circuit board. The invention contemplates that an electrical switch be provided on the header connector in such a manner that the switch is actuated in response to insertion or ejection of the IC pack. The switch is interconnected to electrical traces on the printed circuit board.

Irr the preferred embodiment of the invention, the electrical switch is provided by way of a pair of normally spaced-apart contacts, whereby the contacts are closed in response to ejection of the IC pack from the header connector. As disclosed herein, the connector apparatus also includes an IC pack ejector mechanism having a movably mounted actuator rod. The electrical switch is positioned so as to have one of its contacts movably mounted in the path of movement of the actuator rod for actuation thereby as the IC pack is extracted from the header connector. That is to say, upon ejection of an IC pack, a portion of the actuator rod closes the switch contacts before the IC pack/header connection is broken.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the FIGURES and in which:

DETAILED DESCRIPTION OF THE PREFERRED EMBODIMENT

Figure 1:
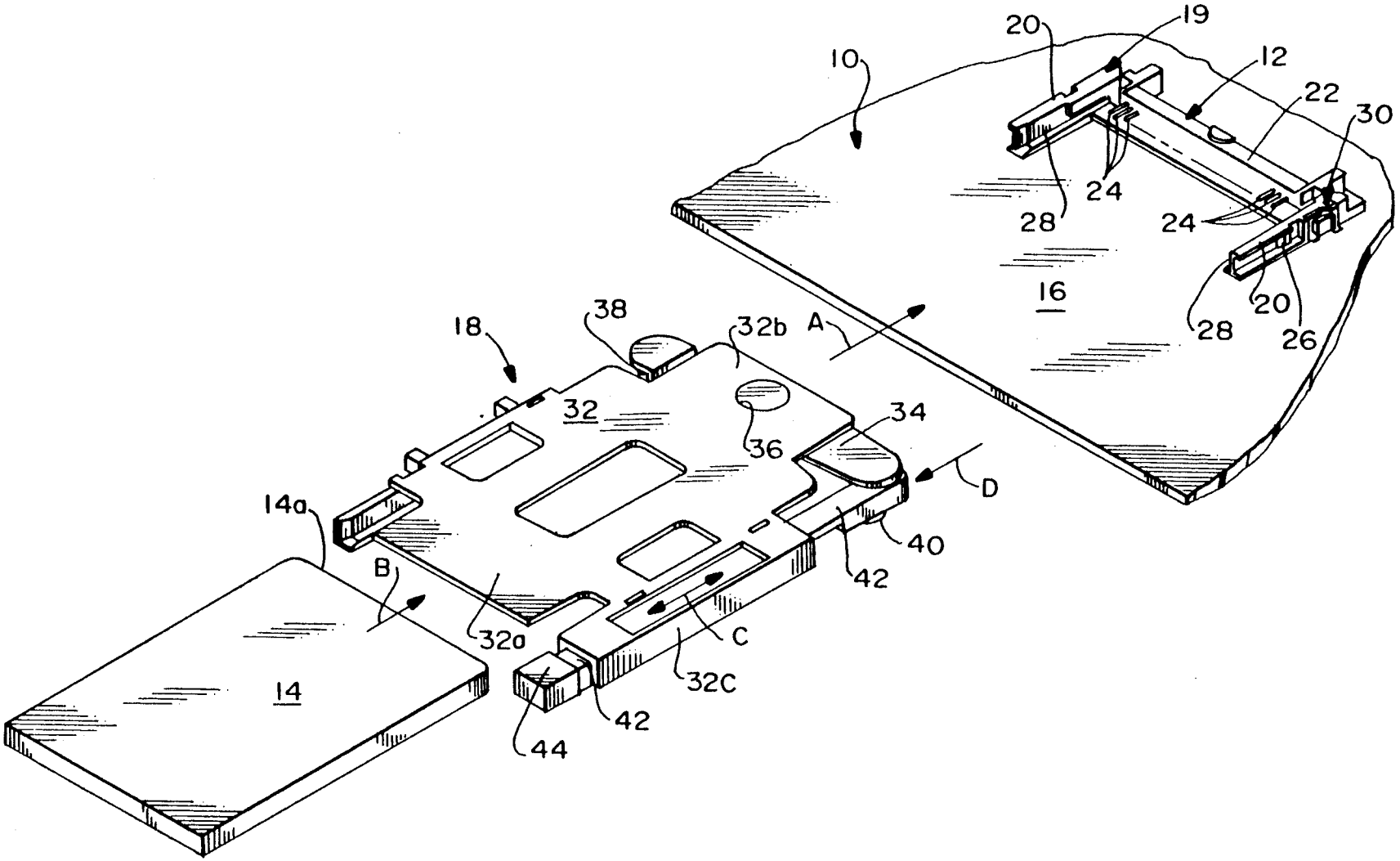
FIG. 1 is an exploded perspective view of the connector apparatus of the invention, including a header connector mounted to a printed circuit board, an ejector mechanism and an IC pack.

Referring to the drawings in greater detail, and first to FIG. 1, the invention is embodied in a connector apparatus, generally designated 10, which includes a header connector, generally designated 12, for providing interconnection between an IC pack 14 and a printed circuit board 16. The header connector is adapted for receiving an ejector mechanism, generally designated 18, in the direction of arrow "A". The ejector mechanism receives the IC pack in the direction of arrow "B".

Figure 2:
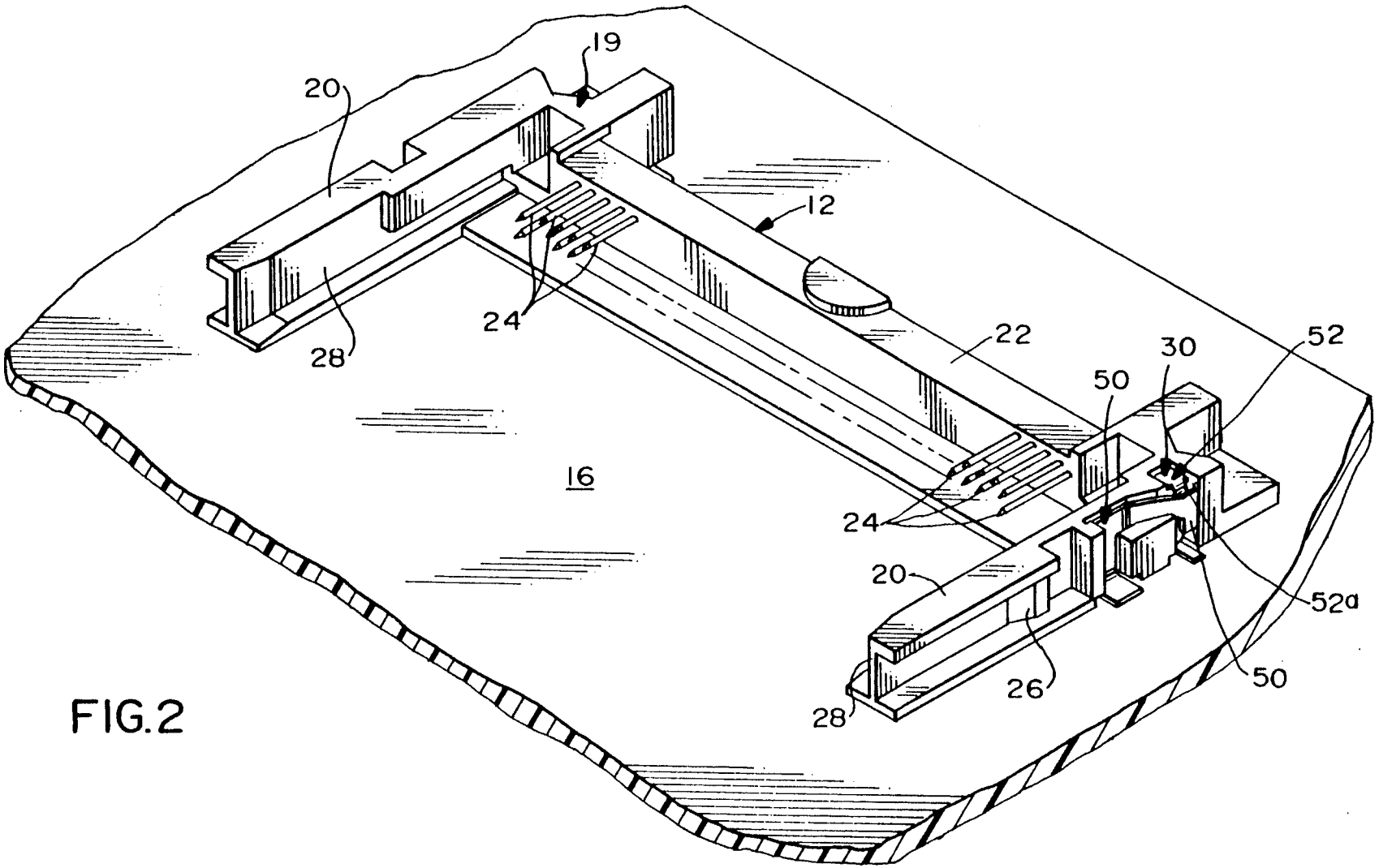
FIG. 2 is an enlarged perspective view of the header connector mounted to the printed circuit board.

Referring to FIG. 2 in conjunction with FIG. 1, header connector 12 is of a known configuration and includes a dielectric housing 19 defined by a pair of side portions 20 joined by a connector section 22 which mounts a plurality of terminals having pin portions 24 projecting generally parallel to the plane of the printed circuit board toward the IC pack between side portions 20. The terminals include tail portions (not shown) connected to circuit traces on the upper surface of printed circuit board 16, as by soldering. Side portions 20 include latch means 26 on the outside thereof for latching interengagement with inside latch means (not shown) of ejector mechanism 18. The side portions also include guide grooves 28 on the inside thereof for guiding IC pack 14 into the header connector, whereby socket terminals (not shown) in forward edge 14*a* of the IC pack interengage with pin portions 24 of the terminals of the header connector. Lastly, an electrical switch 30 is provided on the header connector at the outside of one of the side portions 20, the right-hand side portion as viewed in the drawings, for purposes to be described hereinafter. Suffice it to say at this point, the electrical switch is actuated in response to ejection of IC pack 14 from header connector 12 with ejector mechanism 18 mounted on the connector.

Ejector mechanism 18 is of a known construction in that it includes a generally rectangular frame 32 having one end 32*a* adapted to receive IC pack 14 and an opposite end 32*b* adapted to be attached to header connector 12. An ejector lever 34 is pivotally mounted, as at 36, to frame 32. One end of the lever includes an ejector pin 38 for engaging the front edge 14*a* of IC pack 14 which is inserted into the ejector mechanism. The opposite end of ejector lever 34 is interengaged by a pivot connection 40 to the inner end of an actuator rod 42 having a push button 44 at its outer end. The actuator rod is movably mounted within the frame 32 in side portion 32*c* for reciprocal movement therewithin in the direction of double-headed arrow "C".

In assembly, header connector 12 is mounted to printed circuit board 16 with the terminals of the connector interconnected to circuit traces on the printed circuit board via a soldering process. Ejector mechanism 18 may then be assembled to the header connector by interengageably latching thereto. IC packs or memory cards, such as IC pack 14, then can be inserted into and extracted from header connector 12 by using ejector mechanism 18.

In operation, when an IC pack is inserted into the header connector, the leading edge 14*a* of the IC pack engages ejector pin 38 and pivots ejector lever 34 which, in turn, moves actuator rod 42 in the direction of arrow "D" (FIG. 1) so that push button 44 projects outwardly of frame 32. When it is desired to extract the IC pack from the header connector, an operator pushes on button 44 to move actuator rod 42 in a direction opposite the direction of arrow "D". This pivots or rotates ejector lever 34 and causes ejector pin 38 to eject the IC pack by engagement of the pin with the leading edge 14*a* of the IC pack. The ejector mechanism 18 then is in the position shown in FIG. 1 for the reinsertion of the IC pack or the insertion of a new or different IC pack or memory card.

Figure 3:
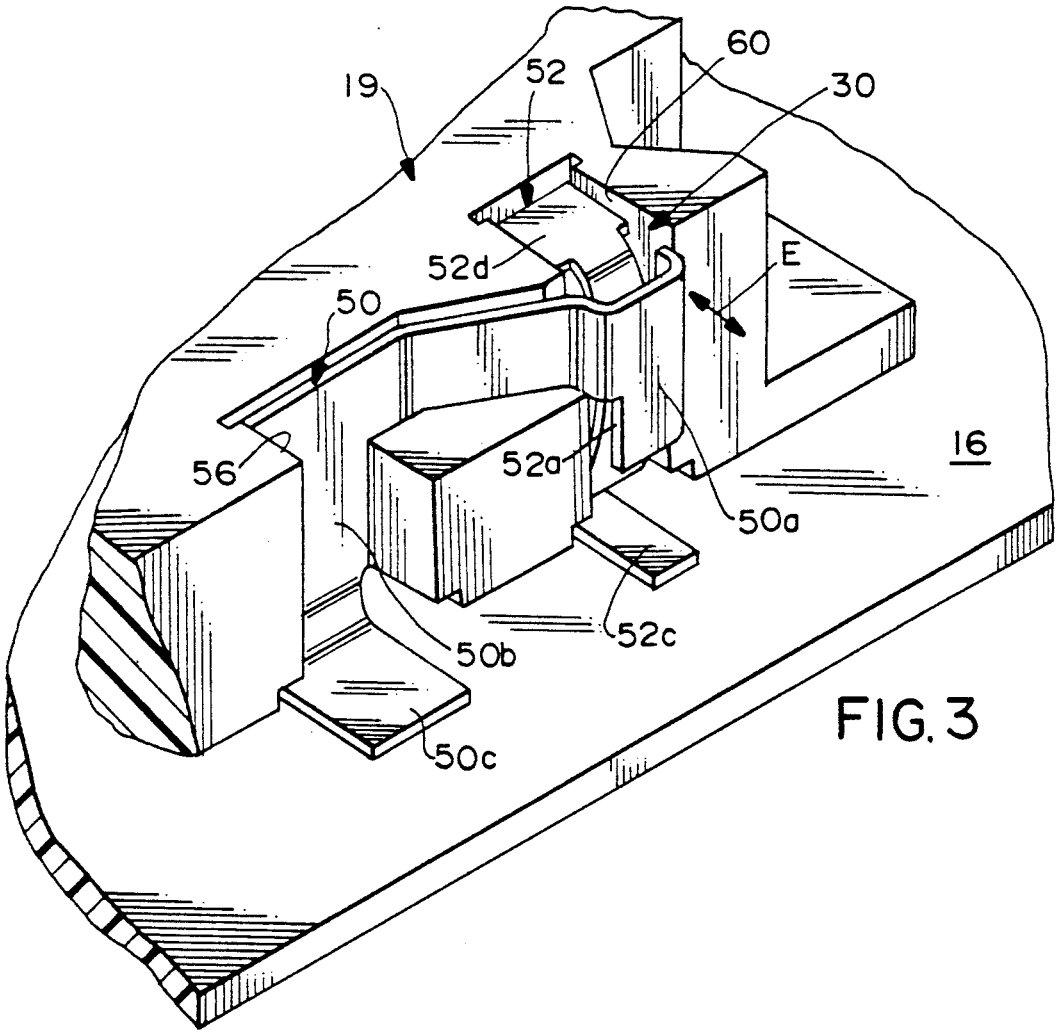
FIG. 3 is a further enlarged perspective view of the switch on the header connector.
Figure 4:
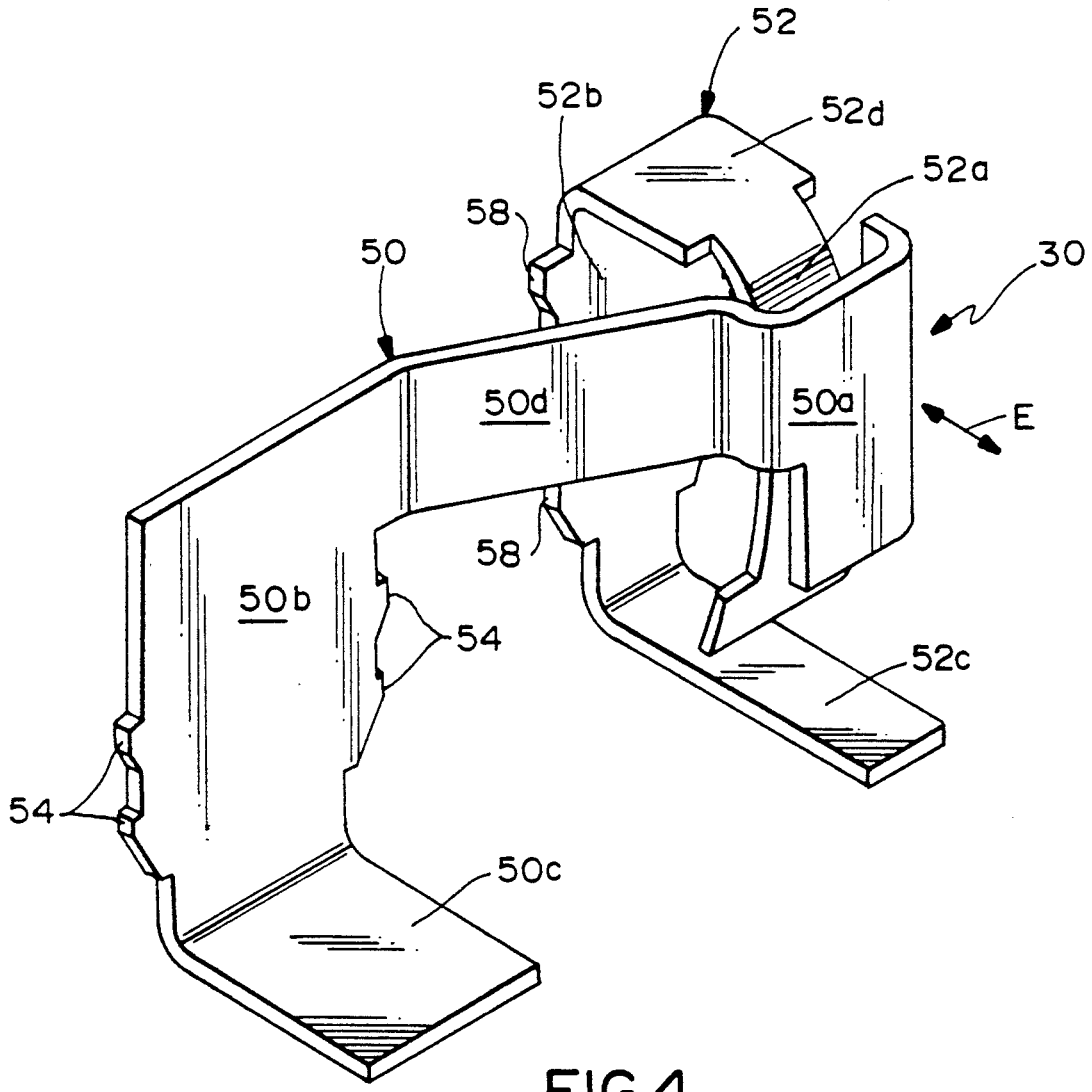
FIG. 4 is a perspective view of the closed contacts of the switch removed from the header connector.

Referring to FIGS. 3 and 4 in conjunction with FIGS. 1 and 2, electrical switch 30 is embodied in a pair of electrical contacts, generally designated 50 and 52. The contacts are stamped and formed of sheet metal material and are mounted in dielectric frame 19 of header connector 12 such that contact portions 50*a* and 52*a* of contacts 50 and 52, respectively, are normally spaced-apart. More particularly, contact 50 includes an anchoring portion 50*b* having barbs 54 (FIG. 4) in its side edges for skiving into the material of dielectric frame 19 within a groove 56 (FIG. 3). This secures contact 50 rigidly within the header connector. Contact 50 further includes a foot portion 50*c* for soldering to a circuit trace on printed circuit board 16. Contact portion 50*a* is joined to anchoring portion 50*b* by a spring arm 50*d* so that the contact portion is movable in the direction of double-headed arrow "E", but the contact portion is biased toward its normally open position shown in FIGS. 3 and 4.

Contact 52 similarly includes an anchoring portion 52*b* having barbs 58 (FIG. 4) for skiving into the dielectric material of header connector frame 19, within a groove 60 (FIG. 3) of the frame. Contact 52 also includes a foot portion 52*c* for soldering to a circuit trace on printed circuit board 16. Contact portion 52*a* is joined to anchoring portion 52*b* by a rigid arm 52*d*. Contact portion 52*a* is cantilevered downwardly from arm portion 52*d* and is spaced from contact portion 50*a* of contact 50 in the normally open condition of the switch. Therefore, contact portion 52*a* of contact 52 may be considered the fixed contact of switch 30 and contact portion 50*a* of contact 50 may be considered the movable contact of the switch.

Figure 5:
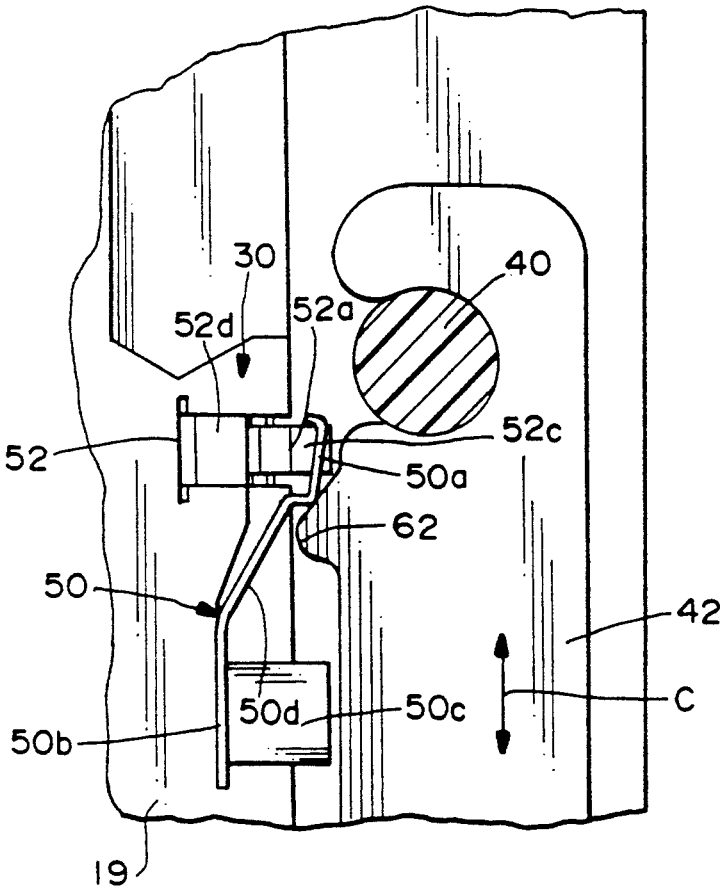
FIG. 5 is a top plan view of the switch in its open condition, adjacent the actuator rod of the ejector mechanism.
Figure 6:
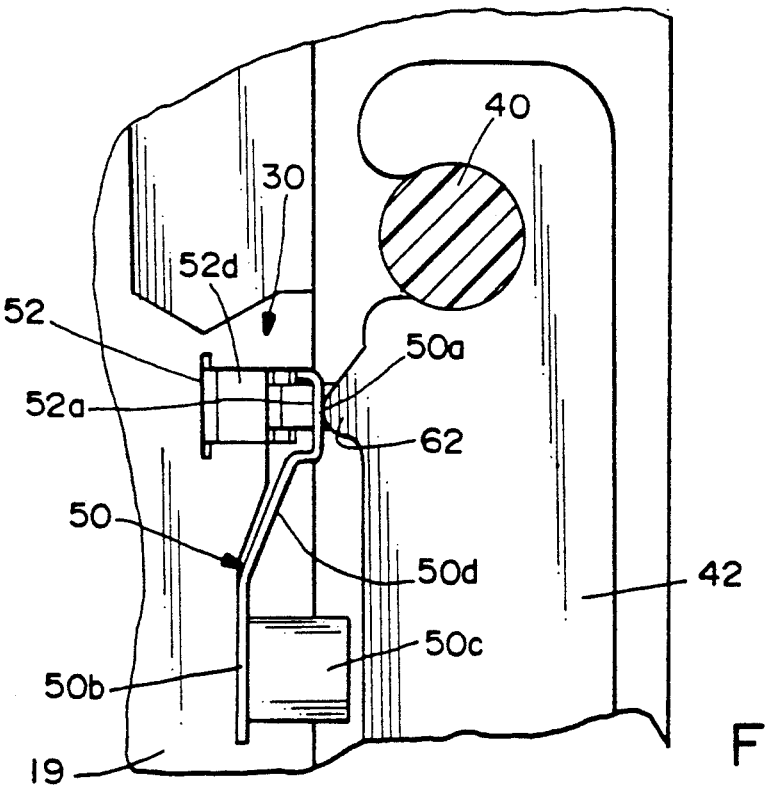
FIG. 6 is a view similar to that of FIG. 5, with the actuator rod moved to a position of closing the switch.

Referring to FIGS. 5 and 6, the location of switch 30 in relation to actuator rod 42 of ejector mechanism 18 (FIG. 1) is illustrated. Furthermore, it can be seen that the actuator rod has an inwardly projecting boss 62. As stated above, the actuator rod of the ejector mechanism is reciprocally movable in the direction of double-headed arrow "C". It can be seen in FIGS. 5 and 6 that movable contact portion 50*a* of contact 50 of electrical switch 30 is located in the path of movement of boss 62 of actuator rod 42. The boss projects inwardly a sufficient distance to cause movable contact portion 50*a* to engage contact portion 52*a* of contact 52 for each "stroke" of actuator rod 52, i.e. for each time boss 62 meets the switch. Contact portion 52*a* is sufficiently resilient to prevent any damage to the switch construction. In essence, it can be understood that the above-described construction of electrical switch 30, along with its location and that of actuation by boss 62 of the movable actuator rod, forms a switch means which is actuated by movement or operation of ejector mechanism 18, and more specifically, by the action of actuator rod 42.

Therefore, in operation, when an IC pack is inserted into header connector 12, with ejector mechanism 18 in the condition shown in FIG. 1, edge 14*a* of the IC pack will engage ejector pin 38 which will cause ejector lever 34 to pivot about its pivotal mounting 36. This causes actuator rod 42 to move linearly in the direction of arrow "D" shown in FIG. 1. Now, referring to FIG. 5, the insertion of the IC pack effectively results in boss 62 of actuator rod 42 being positioned as shown in FIG. 5 whereat electrical switch 30 is in its normally open state. That is, the actuator rod is fully out, and boss 62 is positioned below the electrical switch 30, i.e. not in contact with contact portion 50*a*. Upon extraction of the IC pack from the header connector, by pushing on push button 44, actuator rod 42 is moved in a direction opposite the direction of arrow "D" (FIG. 1) into engagement with contact 50*a*. That is, the ejection of the IC pack effectively causes boss 62 of actuator rod 42 to move from the position shown in FIG. 5, to the position shown in FIG. 6 whereat the electrical switch is actuated (i.e. connecting the electrical circuit through the circuit traces on the printed circuit board interconnected to feet 50*c* and 52*c* of the contacts). Therefore, when the push button is actuated to eject the IC pack, the contacts are closed before the IC pack/header connection is broken.

Electrical switch 30 can be used for a variety of purposes, including a shut-down of various processes prior to extraction of an IC pack, so that there is no interference with ongoing processes or data transfer which might be affected by the ejection action. Therefore, electrical switch 30 is located in the path of movement of boss 62 of actuator rod 42 so that the system is shut-down or "notified" prior to disengagement of terminals pins 24 from the terminal sockets of the IC pack, and, upon insertion of an IC pack, to open the switch and allow the system to operate and/or transfer data when the terminals have been fully interengaged. Note that depending on the location of the projecting boss along the actuator rod, the switch may be open or closed either when an IC pack is inserted or when it is extracted. Such a design allows for flexibility depending on the specific application.

In addition, by having the switch actuated by a movable member of the ejector mechanism, rather than having the switch directly actuated by the IC pack itself, no modifications of the IC pack or the interface of the fairly conventional header connector need to be made.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a connector apparatus for providing an interconnection between an IC pack and a printed circuit board, including a header connector for mounting on the printed circuit board into which the IC pack is inserted and from which it is ejected, a plurality of terminals on the header connector adapted for interconnection of the IC pack to electrical traces on the printed circuit board, and an IC pack ejector mechanism mounted on the header connector including a reciprocally mounted actuator member adapted to effect disconnection of the IC pack from the header connector, wherein the improvement comprises:

an electrical switch on the header connector adapted to be actuated in response to movement of the IC pack, and including an actuatable portion located in the path of movement of the actuator member, wherein said actuatable portion comprises one of a pair of spaced-apart contacts.

2. In a connector apparatus as set forth in claim 1, wherein said spaced-apart contacts are closed in response to movement of the IC pack within the header connector.

3. A connector apparatus for providing an interconnection between an IC pack and a printed circuit board, comprising:

a header connector for mounting on the printed circuit board into which the IC pack is inserted and from which it is ejected;

a plurality of terminals on the header connector adapted for interconnection of the IC pack to electrical traces on the printed circuit board;

an ejector mechanism for selectively moving an inserted IC pack from an inserted position to an ejected position, including a pivotally mounted ejector lever adapted to effect movement of the IC pack to the ejected position, and a manually manipulatable actuator slidably mounted for movement in the same general direction as the insertion and ejection of the IC pack, the actuator including an actuating boss thereon; and an electrical switch on the header connector including an actuatable portion located in the path of movement of the boss of the actuator for actuation thereby, wherein said actuatable portion comprises one of a pair of spaced-apart contacts.

4. In a connector apparatus for providing an interconnection between an IC pack and an electronic component, including connector means coupled to the electronic component into which the IC pack is inserted and from which it is ejected, a plurality of terminals adapted for interconnection of the IC pack to the electronic component, and an IC pack ejector mechanism having a movably mounted actuator member, wherein the improvement comprises an electrical switch on the connector means actuatable in response to movement of the IC pack, wherein the electrical switch includes an actuatable portion located in the path of movement of the actuator member, said actuatable portion defined by one of a pair of spaced-apart contacts.

5. In a connector apparatus as set forth in claim 4, wherein said spaced-apart contacts are closed in response to ejection of the IC pack from the connector means.

* * * * *